US009249489B2

(12) United States Patent
Nakamura et al.

(10) Patent No.: US 9,249,489 B2
(45) Date of Patent: Feb. 2, 2016

(54) METHOD AND SYSTEM FOR MANUFACTURING METAL-PLATED STEEL PIPE

(75) Inventors: Shinichiro Nakamura, Tokyo (JP); Tadayoshi Tamamura, Tokyo (JP)

(73) Assignee: Daiwa Steel Tube Industries Co., Ltd., Tokyo (JP)

( * ) Notice: Subject to any disclaimer, the term of this patent is extended or adjusted under 35 U.S.C. 154(b) by 608 days.

(21) Appl. No.: 13/392,360

(22) PCT Filed: Aug. 28, 2009

(86) PCT No.: PCT/JP2009/065062

§ 371 (c)(1),
(2), (4) Date: May 14, 2012

(87) PCT Pub. No.: WO2011/024290

PCT Pub. Date: Mar. 3, 2011

(65) Prior Publication Data

US 2012/0315398 A1 Dec. 13, 2012

(51) Int. Cl.
*B05C 3/02* (2006.01)
*C23C 2/36* (2006.01)
(Continued)

(52) U.S. Cl.
CPC ... *C23C 2/36* (2013.01); *B05C 3/12* (2013.01); *B05D 1/30* (2013.01); *B21C 37/065* (2013.01);
(Continued)

(58) Field of Classification Search
CPC ..... C23C 2/38; C23C 2/003; C23C 6/00; C23C 2/02; B21C 37/09; B21C 43/00; B21C 37/065; B21C 37/101; B21C 37/105; B21C 37/108; B21C 37/153; B05D 1/30; B05D 1/305; B05D 2252/02; B05D 2252/10; B05D 2202/10; B05D 7/146; B05D 7/222
USPC ..... 118/DIG. 10, DIG. 11, DIG. 12, DIG. 13
See application file for complete search history.

(56) References Cited

U.S. PATENT DOCUMENTS 2,597,811 A * 3/1952 Nolan ..... 164/299
3,597,261 A * 8/1971 Coburn et al. ..... 427/378
(Continued)

FOREIGN PATENT DOCUMENTS

CN 1290768 4/2001
JP 52-043454 3/1977
(Continued)

*Primary Examiner* — David Turocy
*Assistant Examiner* — Mohammad Mayy
(74) *Attorney, Agent, or Firm* — Muncy, Geissler, Olds & Lowe, P.C.

(57) ABSTRACT

A system and method for adjusting dipping time in a continuous steel pipe manufacturing line. The system manufactures a steel pipe of which inner and outer faces or any one face thereof is subjected to molten metal-plating from a steel sheet in a continuous manufacturing line, and includes an inner-face plating performing part for molten metal-plating by pouring molten metal to the upper side of the steel sheet corresponding to the inner face of the steel pipe, a steel pipe forming part that obtains a continuous steel pipe by continuously cold-forming the steel sheet subjected to the inner-face plating into a tubular shape and seam-welding a longitudinal end face joint portion of the steel sheet formed in the steel pipe, and an outer-face plating performing part for molten metal-plating by dipping the outer face of the steel pipe into the molten metal, in which a dipping length of the molten metal is adjusted in the inner-face plating performing part and/or the outer-face plating performing part.

12 Claims, 9 Drawing Sheets

(51) Int. Cl.

| | |
|---|---|
| ***B21C 43/00*** | (2006.01) |
| ***B21C 37/06*** | (2006.01) |
| ***B21C 37/10*** | (2006.01) |
| ***B21C 37/15*** | (2006.01) |
| ***B05D 1/30*** | (2006.01) |
| ***B05C 3/12*** | (2006.01) |
| ***B21C 37/09*** | (2006.01) |
| ***C23C 2/00*** | (2006.01) |
| ***C23C 2/02*** | (2006.01) |
| ***C23C 2/38*** | (2006.01) |
| ***C23C 6/00*** | (2006.01) |

(52) U.S. Cl.

CPC ..... *B21C 37/09* (2013.01); *B21C 37/101* (2013.01); *B21C 37/105* (2013.01); *B21C 37/108* (2013.01); *B21C 37/153* (2013.01); *B21C 43/00* (2013.01); *C23C 2/003* (2013.01); *C23C 2/02* (2013.01); *C23C 2/38* (2013.01); *C23C 6/00* (2013.01)

(56) References Cited

U.S. PATENT DOCUMENTS

| | | | | | |
|---|---|---|---|---|---|
| 3,956,537 | A | * | 5/1976 | Raymond | 427/433 |
| 5,251,804 | A | * | 10/1993 | Nakamura | 228/147 |
| 5,506,002 | A | * | 4/1996 | Maitra et al. | 427/420 |
| 5,512,321 | A | * | 4/1996 | Paramonov et al. | 427/405 |
| 6,242,048 | B1 | | 6/2001 | Iida et al. | |

FOREIGN PATENT DOCUMENTS

| | | | | | |
|---|---|---|---|---|---|
| JP | 56-116864 | | | 9/1981 | |
| JP | 1-149948 | | | 6/1989 | |
| JP | 5-148607 | | | 6/1993 | |
| JP | 5-287480 | | | 11/1993 | |
| JP | 7-243015 | | | 9/1995 | |
| JP | 9-241814 | | | 9/1997 | |
| JP | 2000-087203 | | | 3/2000 | |
| JP | 2000-219946 | | | 8/2000 | |
| JP | 2000-219947 | | | 8/2000 | |
| JP | 2004-083950 | | | 3/2004 | |
| WO | WO 2007/073060 | A1 | * | 6/2007 | C23C 2/00 |

* cited by examiner

RELATION TABLE BETWEEN PLATING STRENGTH AND DIPPING LENGTH

※RELATION BETWEEN DIPPING TIME AND THICKNESS OF GALVANIZED ALLOY LAYER

FIG. 10

※THICKNESS OF ALLOY LAYER, ZINC ATTACHMENT AMOUNT

| No. | ※ | HYDRAULIC FLATNESS (ADHENSION) | ※ | HYDRAULIC FLATNESS (1/2D) |
|---|---|---|---|---|
| 1 | 2.43 μ<br>97g/m² | NON-CRACKING AND NON-PEELING OF PLATED LAYER | | NON-CRACKING AND NON-PEELING OF PLATED LAYER |
| 2 | | | 2.80 μ<br>97g/m² | NON-CRACKING AND NON-PEELING OF PLATED LAYER |
| 3 | | | 2.98 μ<br>97g/m² | NON-CRACKING AND NON-PEELING OF PLATED LAYER |
| 4 | | | 3.22 μ<br>97g/m² | NON-CRACKING AND NON-PEELING OF PLATED LAYER |
| 5 | | | 3.04 μ<br>97g/m² | NON-CRACKING AND NON-PEELING OF PLATED LAYER |
| 6 | | | 2.08 μ<br>97g/m² | NON-CRACKING AND NON-PEELING OF PLATED LAYER |
| 7 | | | 2.82 μ<br>97g/m² | NON-CRACKING AND NON-PEELING OF PLATED LAYER |

FIG. 11

※THICKNESS OF ALLOY LAYER, ZINC ATTACHMENT AMOUNT

| No. | ※ | HYDRAULIC FLATNESS (ADHENSION) | ※ | HYDRAULIC FLATNESS (1/2D) |
|---|---|---|---|---|
| 8 | 4.12 μ<br>103g/m² | 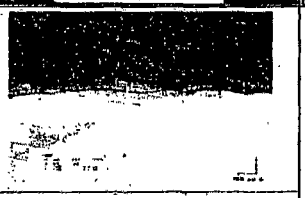 <br>NON-CRACKING AND NON-PEELING OF PLATED LAYER | | 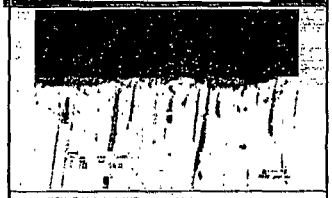 <br>NON-CRACKING AND NON-PEELING OF PLATED LAYER |
| 9 | 4.43 μ<br>80g/m² | 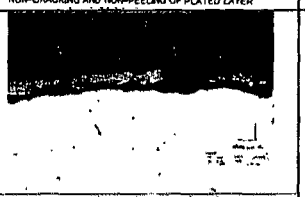 <br>CRACKING AND PEELING OF PLATED LAYER | | 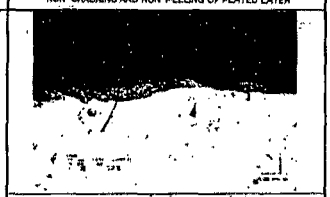 <br>NON-CRACKING AND NON-PEELING OF PLATED LAYER |
| 10 | 2.67 μ<br>99g/m² | 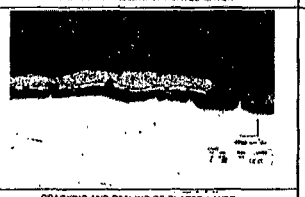 <br>CRACKING AND PEELING OF PLATED LAYER | | 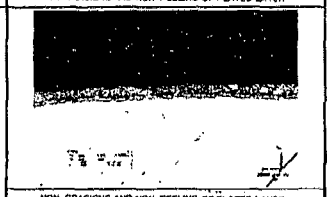 <br>NON-CRACKING AND NON-PEELING OF PLATED LAYER |
| 11 | 4.91 μ<br>88g/m² | 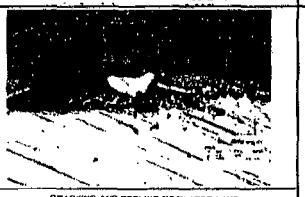 <br>CRACKING AND PEELING OF PLATED LAYER | | 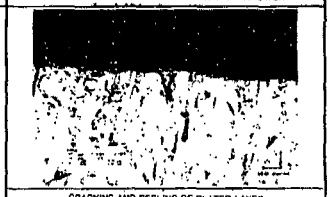 <br>CRACKING AND PEELING OF PLATED LAYER |
| 12 | 5.41 μ<br>93g/m² | 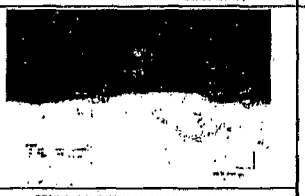 <br>CRACKING AND PEELING OF PLATED LAYER | | 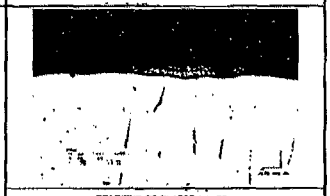 <br>CRACKING OF PLATED LAYER |
| 13 | 5.60 μ<br>93g/m² | 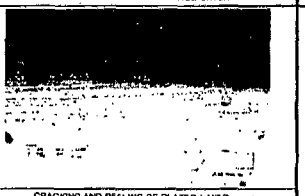 <br>CRACKING AND PEELING OF PLATED LAYER | | 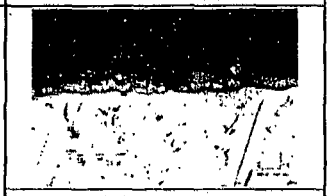 <br>CRACKING OF PLATED LAYER |
| 14 | 6.48 μ<br>106g/m² | 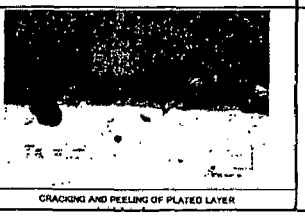 <br>CRACKING AND PEELING OF PLATED LAYER | | 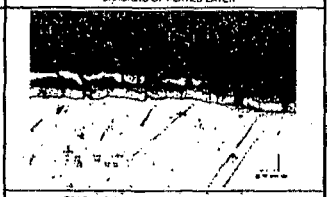 <br>CRACKING AND PEELING OF PLATED LAYER |

FIG. 12

※THICKNESS OF ALLOY LAYER, ZINC ATTACHMENT AMOUNT

| No. | ※ | HYDRAULIC FLATNESS (ADHENSION) | ※ | HYDRAULIC FLATNESS (1/2D) |
|---|---|---|---|---|
| 15 | 3.92 μ<br>101g/m² | 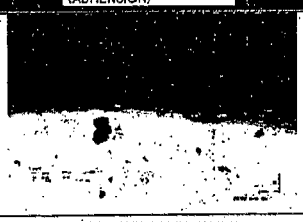 <br>CRACKING AND PEELING OF PLATED LAYER | | 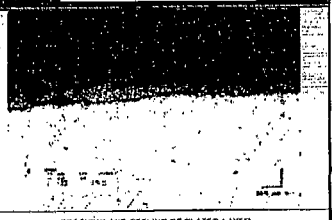 <br>CRACKING AND PEELING OF PLATED LAYER |
| 16 | 8.96 μ<br>138g/m² | 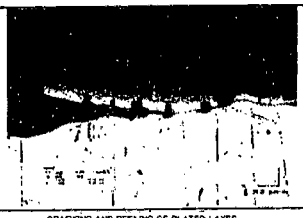 <br>CRACKING AND PEELING OF PLATED LAYER | | 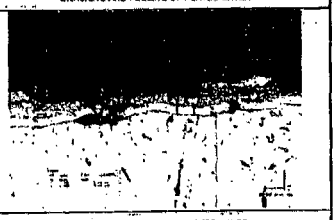 <br>CRACKING AND PEELING OF PLATED LAYER |
| 17 | 9.33 μ<br>152g/m² | 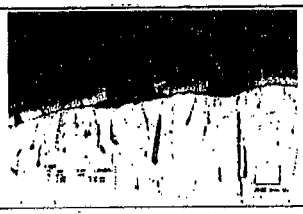 <br>CRACKING AND PEELING OF PLATED LAYER | | 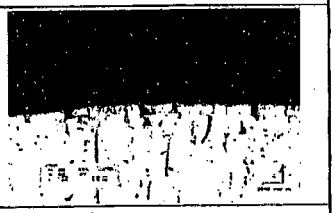 <br>CRACKING AND PEELING OF PLATED LAYER |
| 18 | 11.21 μ<br>166g/m² | 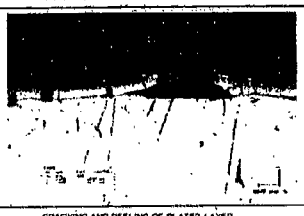 <br>CRACKING AND PEELING OF PLATED LAYER | | 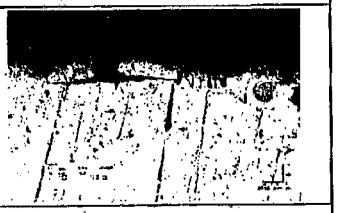 <br>CRACKING AND PEELING OF PLATED LAYER |

METHOD AND SYSTEM FOR MANUFACTURING METAL-PLATED STEEL PIPE

BACKGROUND OF THE INVENTION

The present invention relates to a technique of manufacturing a metal-plated steel pipe, of which inner and outer faces or any one of them are subjected to molten metal-plating, by a continuous steel pipe manufacturing line.

Hitherto, as one of representative methods of performing molten metal-plating on a steel pipe, there is a known hot-dipping method. Further, in recent years, a method of manufacturing a molten metal-plated steel pipe in a continuous steel pipe manufacturing line has been proposed from the viewpoint of a decrease in the cost. As one of the methods, Japanese Patent Application Publication No. S52-43454 discloses a technique of manufacturing an outer-face plated steel pipe in a manner such that a steel sheet is continuously cold-formed into a tubular shape and the result is welded and is plated with molten metal. Furthermore, there is a growing need to perform an inner-face metal plating in recent years. Therefore, JP-A No. H05-148607 discloses a method of easily plating both inner and outer faces of a steel pipe with molten metal in a continuous line in a manner such that one face in a steel sheet corresponding to the inner face of the steel pipe is subjected to plating in a steel pipe manufacturing line, the result is cold-formed into a tubular shape, a longitudinal end face of the steel sheet is welded, and the outer face of the steel pipe is subjected to molten metal-plating.

SUMMARY OF THE INVENTION

Various specifications are required in the steel pipe which is manufactured in the continuous line. That is, the diameter of the steel pipe and characteristics such as corrosion resistance thereof need to be changed depending on the requirements of the consumers. Thus, in the continuous line, a steel pipe according to one specification is manufactured, and thereafter a steel pipe according to another specification is manufactured. However, at this time, there is a need to adjust a molten metal dipping time in the plating. In the case of the general dipping plating, only the molten metal dipping time may be adjusted. However, in the plating of the continuous line, the line speed needs to be changed in order to adjust the dipping time, which affects the manufacturing efficiency and so on.

Thus, the present invention is directed to providing a system and a method capable of easily adjusting the dipping time in the continuous steel pipe manufacturing line.

Further, in the continuous line, the line needs to be stopped or the line speed needs to be decreased when any trouble occurs. When the line is temporarily stopped and restarted in order to perform plating in the continuous line, since the plating is performed after the pretreatment, an unplated portion may be generated in the length necessary for the spent time, which leads to an increase in the cost. Thus, the line speed may be decreased so that the continuous line does not stop. However, when the line speed is decreased in this way, the molten metal dipping time is extended at the time of processing the manufactured plated steel pipe, thereby causing a problem in that the plating is cracked or peeled.

Thus, the present invention is directed to providing a method and a system capable of making the plating dipping time constant so as to correspond to a change in the line speed without stopping the line in the method of manufacturing the steel pipe in the continuous line.

According to the present invention, there is provided a steel pipe manufacturing system that manufactures a steel pipe, of which inner and outer faces or any one face thereof is subjected to molten metal-plating, from a steel sheet in a continuous manufacturing line in which the system includes: an inner-face plating performing part (unit) such as the inner-face molten metal-plating device 5 that performs molten metal-plating by pouring molten metal to the upper side of the steel sheet corresponding to the inner face of the steel pipe; a steel pipe forming part such as the forming device 7 and the welding device 8 for obtaining a continuous steel pipe by continuously cold-forming the steel sheet subjected to the inner-face plating into a tubular shape and seam-welding a longitudinal end face joint portion of the steel sheet formed in the steel pipe; and an outer-face plating performing part such as the outer-face molten metal-plating device 13 that performs molten metal-plating by dipping the outer face of the steel pipe into molten metal, in which a dipping length of molten metal is adjustable in the inner-face plating performing part and/or the outer-face plating performing part.

The present invention further provides the above system in which the inner-face plating performing part such as the inner-face molten metal-plating device 5 includes a pouring part such as the pouring part 501 that pours molten metal to the upper side of the steel sheet, a molten metal supply part such as the molten metal pump 550 that supplies molten metal to the pouring part, and an inner-face wiping part such as the inner-face wiping part 503 that removes molten metal poured by the pouring part, and in which the relative distance between the initial molten metal pouring position and the position of the inner-face wiping part is adjustable.

The present invention further provides the above system of the invention in which the pouring part has a movable means such as the movable part 504 that is movable in parallel to a direction where the steel sheet advances.

The present invention further provides the above system in which the position of the inner-face wiping part is fixed.

The present invention further provides the above system in which the outer-face plating performing part includes a plurality of dipping parts such as the dipping parts 601 which have a space for allowing the continuous steel pipe to pass therethrough, allow the outer face of the continuous steel pipe to be dipped into molten metal when molten metal is introduced into the space, and are continuously arranged in a direction where the continuous steel pipe advances, an outer-face wiping part such as the wiping part 602 that removes surplus metal from the continuous steel pipe dipped into molten metal by the dipping part, and a molten metal supply part such as the molten metal pump 550 that can supply molten metal into the dipping part, in which the molten metal supply part is, on the supply, able to change the number of the dipping part (s) which molten metal is to be supplied.

The present invention further provides the above system in which the outer-face wiping part is installed immediately after each of the plurality of dipping parts, and which can determine that any wiping part(s) of the plurality of wiping parts is to be operated.

The present invention further provides the above system according to the invention in which the outer-face wiping part(s) installed between the dipping parts is(are) a movable open circular type wiping part(s) such as the movable open circular type wiping part 602-1 which includes an annular portion such as the annular portion 60201 surrounding the continuous steel pipe and a plurality of gas ejecting holes such as gas ejecting holes 60202 formed inside the annular portion and in which the annular portion is ring-opened and movable to a position distant from the continuous steel pipe.

According to the present invention, there is provided a method of manufacturing a steel pipe, of which inner and outer faces are subjected to molten metal-plating, from a steel sheet in a continuous manufacturing line, the method including: inner-face metal-plating of performing molten metal-plating by pouring molten metal to the upper side of the steel sheet corresponding to the inner face of the steel pipe; steel pipe forming of obtaining the continuous steel pipe by continuously cold-forming the steel sheet into a tubular shape after the inner-face metal-plating and seam-welding a longitudinal end face joint portion of the steel sheet formed as the steel pipe; outer-face metal-plating of performing molten metal-plating by dipping the continuous steel pipe after the steel pipe forming; and cutting of obtaining the steel pipe by cutting the continuous steel pipe into a predetermined length after the outer-face metal-plating, in which a dipping length of molten metal is adjusted in the inner-face plating and/or the outer-face plating.

According to the present invention, there is provided a method of manufacturing a steel pipe, of which an inner face is subjected to molten metal-plating, from a steel sheet in a continuous manufacturing line, the method including: inner-face metal-plating of performing molten metal-plating by pouring molten metal to the upper side of the steel sheet corresponding to the inner face of the steel pipe; steel pipe forming of obtaining the continuous steel pipe by continuously cold-forming the steel sheet into a tubular shape after the inner-face metal-plating and seam-welding a longitudinal end face joint portion of the steel sheet formed as the steel pipe; and cutting of obtaining the steel pipe by cutting the continuous steel pipe into a predetermined length after the steel pipe forming, in which a dipping length of molten metal is adjusted in the inner-face metal-plating.

According to the present invention, there is provided a method of manufacturing a steel pipe, of which an outer face is subjected to molten metal-plating, from a steel sheet in a continuous manufacturing line, the method including: steel pipe forming of obtaining the continuous steel pipe by continuously cold-forming the steel sheet into a tubular shape and seam-welding a longitudinal end face joint portion of the steel sheet formed as the steel pipe; outer-face metal-plating of performing molten metal-plating by dipping the continuous steel pipe after the steel pipe forming; and cutting of obtaining the steel pipe by cutting the continuous steel pipe into a predetermined length after the outer-face metal-plating, in which a dipping length of molten metal is adjusted in the outer-face metal-plating.

The present invention provides the above method according to the invention in which the inner-face metal-plating includes pouring of pouring molten metal to the upper side of the steel sheet, and inner-face wiping of removing extra metal after the pouring, and in which the distance between the pouring position and the inner-face wiping position is adjusted.

The present invention provides a method according to the invention above in which the outer-face metal-plating includes continuously installing a plurality of dipping troughs in a direction where the continuous steel pipe advances, the dipping trough having a space allowing the continuous steel pipe to pass therethrough and being able to dip the outer face of the continuous steel pipe into molten metal when molten metal is introduced into the space, supplying molten metal into the dipping trough(s), and dipping the outer face of the continuous steel pipe into molten metal, and outer-face wiping of removing extra metal from the continuous steel pipe dipped in molten metal by the dipping trough(s), and in which the number of the dipping trough(s), which molten metal is to be supplied, is determined, and the outer-face wiping is performed immediately after the trough positioned at the most rear stage among the dipping troughs to which molten metal is supplied.

The present invention provides a method according to the invention above, in which in the inner-face wiping, the molten plating attachment amount is adjusted by the air or inert gas wiping pressure using a blowing-off device.

The present invention provides a method according to the invention above in which the inner-face metal-plating further includes different metal plating of performing metal plating by pouring different molten metal after the pouring.

The present invention provides the method according to the invention above in which the outer-face metal-plating is different metal plating by supplying molten metal, to at least one of the dipping troughs, different from molten metal introduced into the other trough(s).

Herein, the meaning of various technical terms used in the specification will be described. The "dipping length (DLin or DLout) of molten metal" means the distance in which the steel sheet or the steel pipe is dipped into the molten metal and the extra molten metal is removed by the wiping. For example, in the case of the inner-face metal-plating, it means a distance from an initial treatment position (IPin) to the inner-face wiping position (WPin). In the case of the outer-face metal-plating, it means a distance from another initial treatment position (ITout) to the outer-face wiping position (WPout).

More specifically, in the case of the inner-face metal-plating, defining an area through which the steel sheet is treated by the molten metal as a treatment area (TAin), the initial treatment position is located most upstream in the area and, at the position, the poured molten metal comes to contact with the steel sheet. The position is denoted with IPin in FIG. 2B and FIG. 3A. Also, the most downstream position of the treatment area is defined as an end treatment position at which the contact therebetween terminates and denoted with EPin.

Also, in the case of the outer-face metal-plating, defining an area through which the steel pipe is treated by the molten metal as another treatment area (TAout), the initial treatment position is located most upstream in the area and, at the position, the steel pipe first enters a pool filled with molten metal. The position is denoted with IPout in FIG. 5B and FIG. 6. Also, the most downstream position of the treatment area is defined as an end treatment position at which the contact therebetween terminates and denoted with EPout. In an embodiment using a plurality of dipping parts 601*a*-601*d* shown in FIG. 6, the end treatment position (EPout) is determined at the end of the final dipping part 601*d*.

According to one or more aspects of the inventions as described above, in the continuous line for manufacturing the steel pipe, there is an effect that the dipping time according to the required specification may be easily obtained. Furthermore, there is an effect that the plating dipping time may be made constant so as to correspond to a change in the line speed without stopping the line even when any trouble occurs.

According to one or more aspects of the inventions as described above, there is an effect that the plating dipping time may be easily adjusted by adjusting the relative positional relation between the molten metal pouring position and the inner-face wiping part.

According to an aspect of the invention as described above, since the position of the wiping part is fixed, there is an effect that the dipping time may be changed without changing the distance between the wiping position and the subsequent process position.

According to one or more aspects of the inventions as described above, there is an effect that the dipping time may be easily adjusted by changing the number of the supplied dipping part(s).

According to an aspect of the invention as described above, since the distance from the dipping position to the wiping position may be made constant even when the number of the dipping part (s) to which molten metal is supplied is changed, there is an effect that the time from the dipping to the wiping may be made constant.

According to an aspect of the invention as described above, since the wiping part may be moved to a position distant from the exit and the entrance of the dipping part when the wiping part is not operated, there is an effect that the gas ejecting hole may not be blocked by molten metal, such as zinc, flowing out of the exit and the entrance thereof.

According to an aspect of the invention as described above, there is an effect that the plating thickness may be easily adjusted by adjusting the pressure of the blowing-off device.

According to one or more aspects of the inventions as described above, since the inner face or the outer face may be simultaneously plated with different metals, there is an effect that the process may be simplified.

BRIEF DESCRIPTION OF THE DRAWINGS

FIG. 10 is a diagram illustrating a result of a Working Example.

FIG. 11 is a diagram illustrating a result of a Working Example.

FIG. 12 is a diagram illustrating a result of a Working Example.

DETAILED DESCRIPTION OF THE INVENTION

Figure 1:
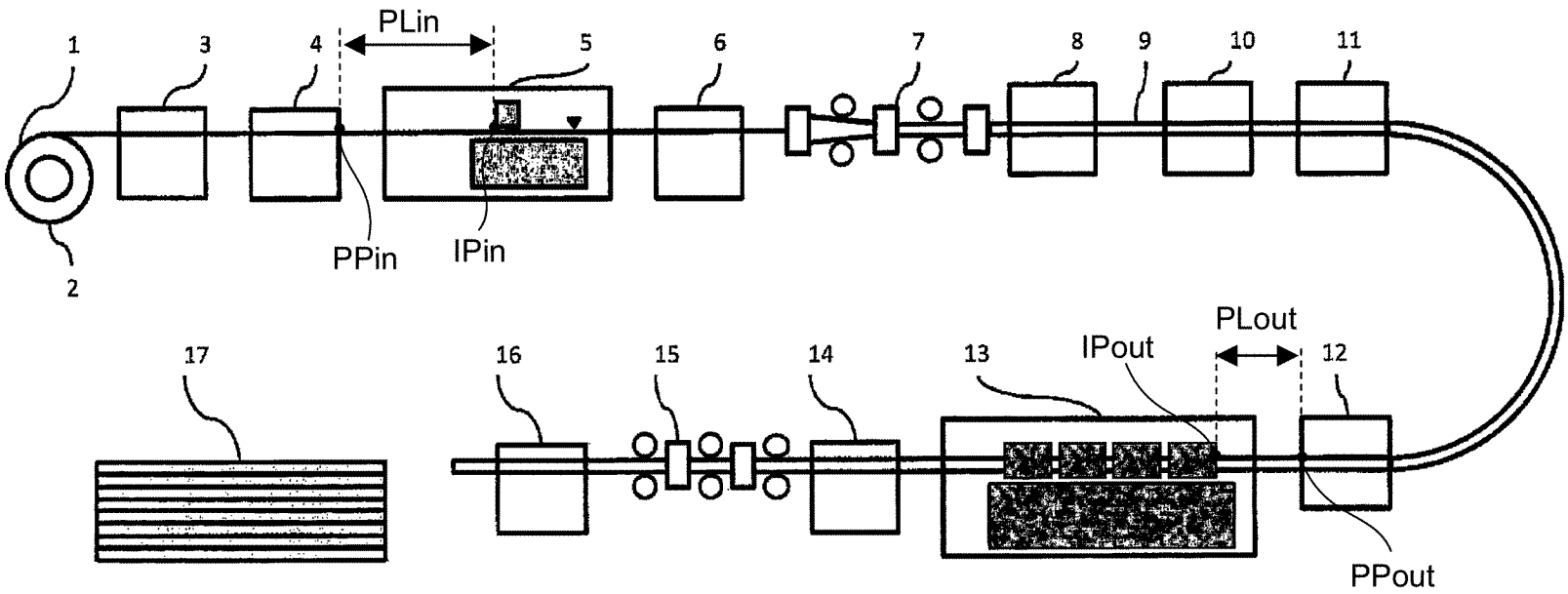
FIG. 1 is a schematic configuration diagram illustrating a molten metal-plating steel pipe manufacturing system according to the invention.

Hereinafter, an embodiment of the invention will be described in detail. FIG. 1 is a schematic configuration diagram illustrating a manufacturing system of molten metal-plating steel pipe according to the embodiment. The manufacturing system includes an uncoiler 2 which continuously supplies an elongated steel sheet wound around a coil 1; a forming device 7 which continuously forms the steel sheet supplied from the uncoiler 2 into a tubular shape; an inner-face molten metal-plating device 5 which allows a steel sheet to be molten metal-plated with desired metal immediately before the steel sheet is continuously formed in a tubular shape; a welding device 8 which forms a tubular body by continuously welding a longitudinal end face joint portion of the plated steel sheet formed in a tubular shape; a cutting device 10 which continuously cuts a welded bead portion formed on the outer face of the tubular body; an outer-face molten metal-plating device 13 which includes plural, for example, four dipping parts and forms a molten metal-plated steel pipe by allowing the outer face of the tubular body to be continuously hot-dip plated; a sizing device 15 which forms a hot dip galvanized steel pipe, so as to be molten metal-plated, into standard dimensions; and a cutting device 16 which cuts the molten metal-plated steel pipe into a predetermined length.

If necessary, a shot blasting device 3, a pretreatment device 4 which performs an oxidization preventing flux liquid applying operation and a drying and preheating operation, a flux applying device 11 which continuously applies a flux liquid for cleaning the outer face of the tubular body and preventing the oxidization thereof, or a preheating device 12 which dries the outer face of the tubular body and preheats the tubular body may be provided. Herein, a length from the pretreatment device 4 to the initial treatment position (IPin) of the inner-face plating performance part is defined as a first length (PLin). More specifically, the length (PLin) is determined from a preheating end position (PPin) of the pretreatment device at which the preheating operation terminates or the steel sheet comes out of the pretreatment device 4. Another length from the preheating device 12 to the initial treatment position (IPout) of the outer-face plating performance part is defined as a second length (PLout). More specifically, the length (PLout) is determined from a preheating end position (PPout) of the preheating device at which the preheating operation terminates or the steel pipe comes out of the preheating device 12. Depending on the property of plating metal, a first cooling trough in an exemplary form of a tank 6 which cools the steel sheet after the molten metal-plating is performed thereon or a second cooling trough 14 which cools the tubular body after the molten metal-plating is performed thereon is provided. The cooling trough is essentially provided if the metal-plating is galvanizing.

Figure 2A:
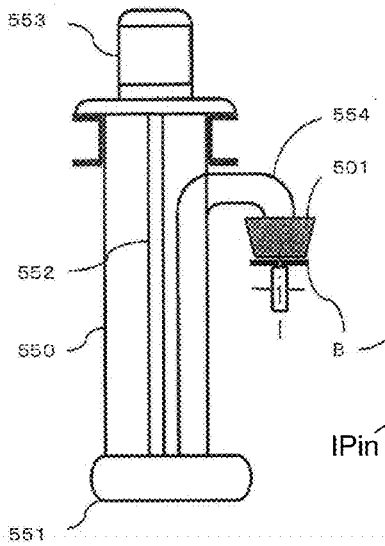
FIGS. 2*a* and 2*b* are schematic configuration diagrams illustrating an inner-face molten metal-plating device according to the invention.
Figure 2B:
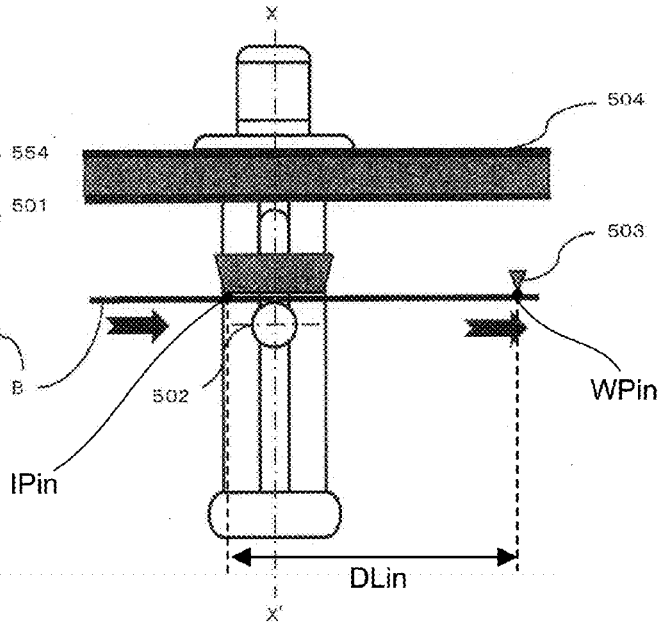
Figure 3A:
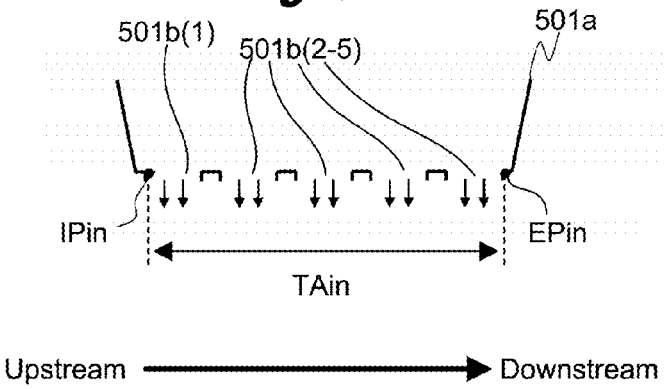
FIGS. 3*a* and 3*b* are schematic configuration diagrams illustrating a pouring part of the inner-face molten metal-plating device according to the invention.
Figure 3B:
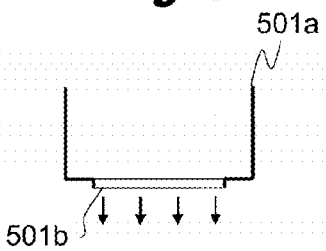

Next, the configuration of the inner-face molten metal-plating device 5 which is the characteristic point of the invention will be described. FIG. 2(*a*) is a schematic cross-sectional view taken along the line X-X' of the inner-face molten metal-plating device 5 according to the embodiment, and FIG. 2(*b*) is a cross-sectional side view illustrating the inner-face molten metal-plating device 5. The inner-face molten metal-plating device 5 according to the embodiment includes a molten metal pump 550 which supplies molten metal into a pouring part; a pouring part 501 which pours molten metal supplied from the molten metal pump to the steel sheet so as to perform a plating treatment thereon; a support part 502 which supports the rear face of the steel sheet so as to prevent the warpage of the steel sheet; an inner-face wiping part 503 (for example, a blowing-off device such as an inert gas or air wiper) which removes surplus molten metal from the pouring part; and a movable part 504 provided, optionally, as a slide base frame for enabling to adjust the relative positional relation between the pouring part and the wiping part. The structure of the movable part 504 will be described later in detail. Here, the molten metal pump 550 includes: an impeller casing 551 which accommodates an impeller for pumping molten metal; an impeller shaft 552 which transmits the rotational driving force of the pump motor to the impeller accommodated in the impeller casing; a pump motor 553 which serves as a power source for pumping molten metal; and a molten metal discharge port 554 which discharges molten metal sent from the impeller casing. Here, the detailed structure of the pouring part 501 will be described. As illustrated in the schematic diagram of FIG. 3, although it is not particularly limited, the pouring part 501 includes, for example, a container 501*a* and five molten metal pouring holes 501*b*(1) to 501*b*(5) which are formed in the bottom portion thereof. Furthermore, here, a dipping length (DLin) of molten metal means the distance from the pouring hole 501*b*(1) positioned at the most upstream side of the line to the wiping part 503 (or inner-face wiping part WPin). Here, the wiping part 503 may be movable, but may be appropriately fixed so as to maintain the distance from the position of the wiping part 503 to the cooling trough to be constant in a case where the cooling trough is needed particularly at the time of performing galvanizing.

Figure 4:
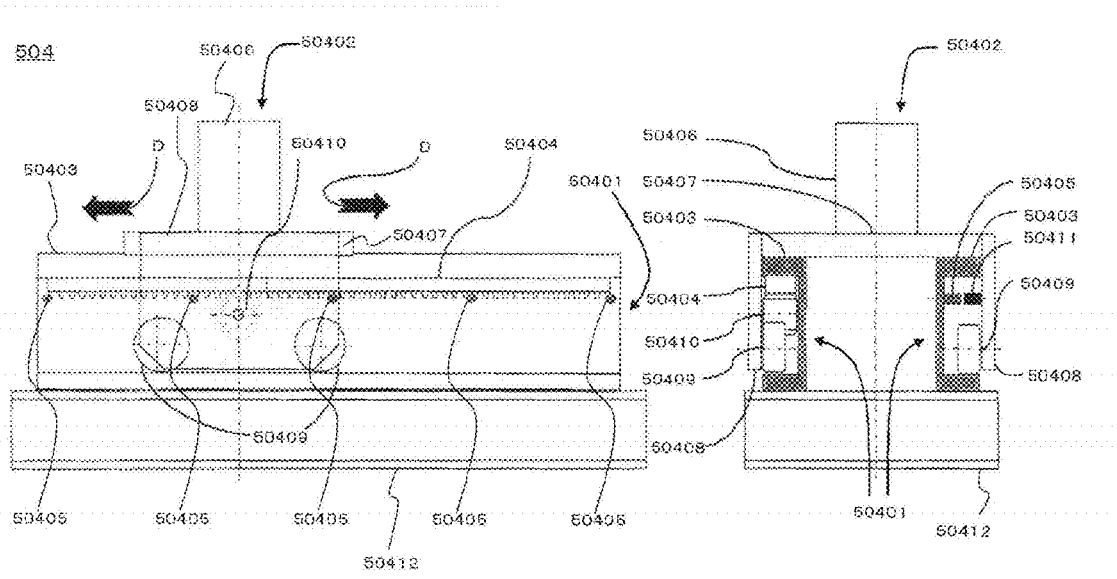
FIG. 4 is a schematic configuration diagram illustrating a movable part of the inner-face molten metal-plating device according to the invention.

FIG. 4 is a schematic diagram illustrating the movable part according to the embodiment. The movable part 504 includes a base frame 50401 and a pump main body base 50402. Furthermore, although it is not illustrated in the drawings, the pump main body base is connected to the pouring part 501, and when its portion moves, the pouring part may be moved and the dipping length of molten metal may be adjusted. The base frame includes a pair of slide base frames 50403; a rack gear 50404 which is formed so as to be fittable to a pinion gear which will be described later and is installed in the substantially entire face of one of the slide base frames; and positioning sensors A50405 which are installed in at least one slide base frame with substantially the same interval therebetween. The pump main body base includes a pump main body 50406; a ceiling plate 50407; side plates 50408 which are formed at both sides of the ceiling plate; a guide roller 50409 which is installed at the two side plates so as to receive the weight of the pump and easily move the pump main body; a pinion gear 50410 which is formed so as to be fittable to the rack gear so as to perform a driving and positioning operation; and a positioning sensor B50411 which is installed in at least one of the side plates. Further, at the lower portion of the base frame, a base frame support body 50412 may be equipped. Due to the strong and reliable transmission without slip through the meshing between the pinion gear 50410 and the rack gear 50404 fixed to the slide base frame 50403, it is configured to be movable to the positioning sensors A50405 which are installed in a distance determined in advance. However, the moving method is not limited to the above-described method. For example, the moving distance may be set without the positioning sensor by using the number of rotations of the pinion gear through an electric motor and a speed changer, a servo motor or the like.

Figure 5A:
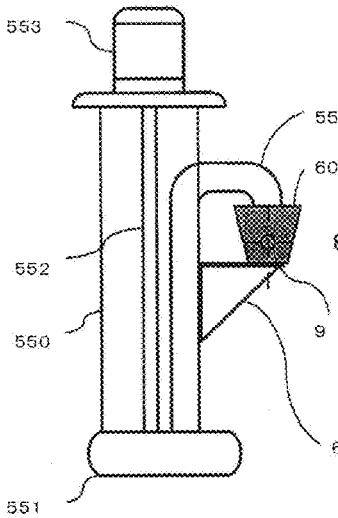
FIGS. 5*a* and 5*b* are schematic configuration diagrams illustrating an outer-face molten metal-plating device according to the invention.
Figure 5B:
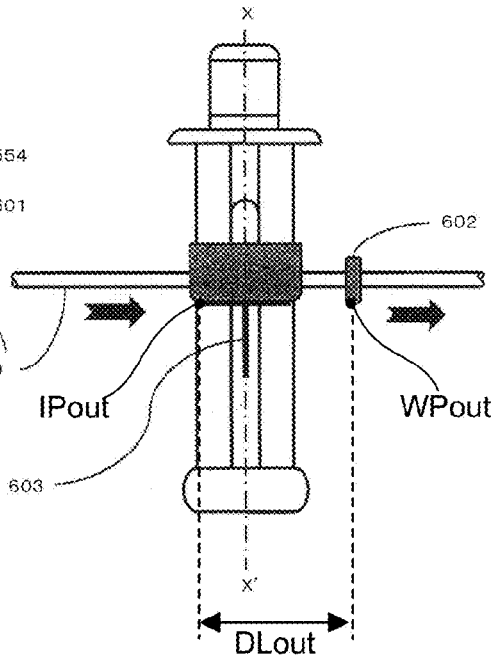
Figure 6:
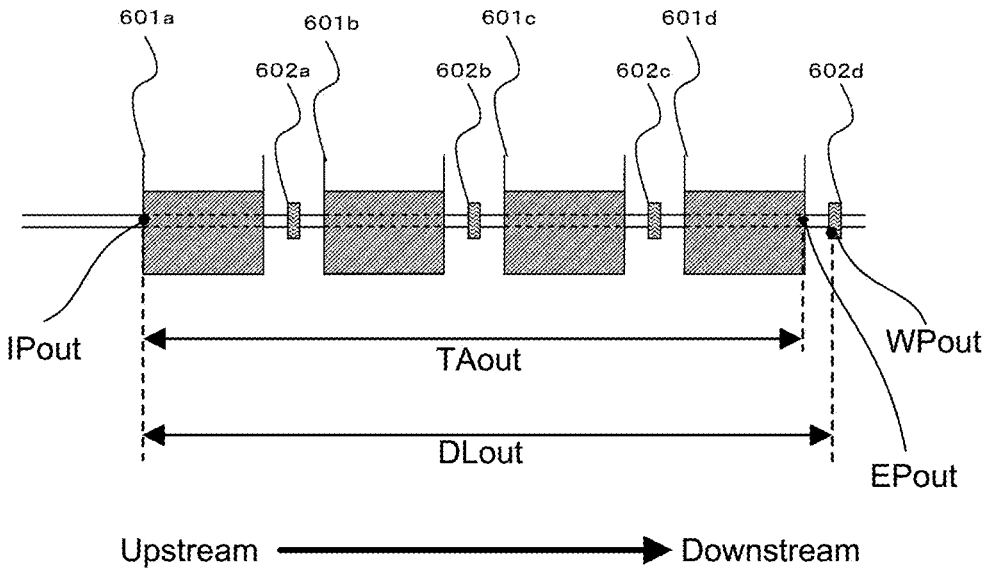
FIG. 6 is a diagram illustrating a shape of a steel pipe and a dipping part of the outer-face molten metal-plating device.
Figure 7:
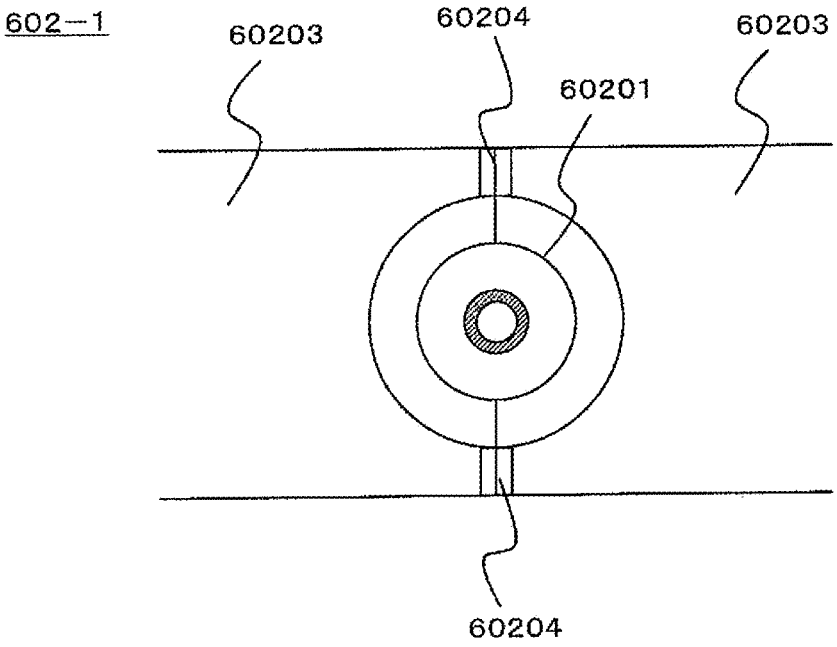
FIG. 7 is a diagram illustrating a schematic configuration of a movable open circular type wiping part.

Next, the configuration of the outer-face molten metal-plating device 13 which is the characteristic point of the invention will be described. Here, the outer-face molten metal-plating device 13 includes plural, for example, four parts illustrated in FIG. 5. These four parts are denoted with 601*a* to 601*d* from the upstream to the downstream. FIG. 5(*a*) is a schematic cross-sectional view taken along the line X-X' of one unit of the outer-face molten metal-plating device 13 according to the embodiment, and FIG. 5(*b*) is a conceptual side view illustrating one unit of the outer-face molten metal-plating device 13. The outer-face molten metal-plating device 13 includes: a molten metal pump 550 which supplies molten metal into a dipping part; a dipping part 601 which stores the molten metal supplied from the molten metal pump and allows the molten metal to pass through the steel pipe 9 so as to perform a molten metal-plating treatment thereon; and a wiping part 602 provided, optionally, as a blowing-off device such as an inert gas or air wiper which removes surplus molten metal attached to the steel pipe at the time of performing the plating treatment by the dipping part. The wiping part will be described later in detail. Furthermore, the wiping part may further include a dipping part support 603 which supports the dipping part. Furthermore, since the configuration of the molten metal pump 550 is the same as that of the inner-face molten metal-plating device 5, the description thereof will not be repeated by giving the same reference numeral thereto. Here, FIG. 6 schematically illustrates the periphery of the steel pipe when these parts are arranged in the outer-face molten metal-plating device. Here, in the outer-face molten metal-plating device 13, the respective dipping parts 601 are continuously arranged in a direction where the steel pipe advances. Further, with regard to the distance from the exit to the entrance between the respective dipping parts, it is desirable to set the distance so that the steel pipe is continuously dipped in the molten metal flowing out of the exit and the entrance of the dipping parts. The wiping part 602 is provided at the downstream of each dipping part. It is desirable to configure the wiping parts so that only the wiping part(s) immediately after the dipping part(s) to which molten metal is supplied is(are) operated. This is because the wiping cools the steel pipe dipped in the molten metal and affects the quality of plating. Here, the wiping parts 602*a* to 602*c* which are provided between the dipping parts are movable ring-opening type wiping parts 602-1. FIG. 7 illustrates the configuration of the movable open circular type wiping part 602-1. The movable open circular type wiping part 602-1 includes an annular portion 60201 which surrounds the outer periphery of the steel pipe; plural gas ejecting holes 60202 (not shown) which are formed inside the annular portion and blow a gas toward the steel pipe; and support bodies 60203 which support the annular portion. Here, the annular portion 60201 includes a notch 60204 which halves the annular portion, and when the support bodies are operated so as to be away from each other, the support bodies may be movable to a position distant from the steel pipe. With such a moving mechanism, since the wiping part may be movable to a position distant from the exit and the entrance of the dipping parts when the movable open circular type wiping part is not operated, the gas ejecting holes are not blocked by the molten zinc which flows out of the exit and the entrance. In this way, since there are plural outer-face molten metal dipping parts according to the invention, when the number of the dipping parts to which the molten metal is supplied is(are) adjusted, the thickness of the plated alloy layer of the outer face of the steel pipe may be equalized by adjusting the dipping length (DLout) of the molten metal in accordance with a change in the line speed. Furthermore, the outer-face molten metal-plating device 13 may be used at the time of plating the same type of metal (for example, molten zinc). At the time of further plating (special plating) different metal, the different metal may be introduced into the dipping part(s). Further, in addition to the outer-face molten metal-plating device 13, another outer-face molten metal-plating device (with, for example, the same configuration) may be installed at the downstream of the outer-face molten metal-plating device 13.

Next, the manufacturing method of the invention using the above-described manufacturing line will be described. First, the steel sheet which is wound in a coil shape is continuously supplied from the uncoiler 2 toward the downstream side of the line. Next, a predetermined pretreatment is performed on the steel sheet by the shot blasting device 3 or the pretreatment device 4, and then an inner-face plating treatment is performed on one face of the supplied the steel sheet by the inner-face molten metal-plating device 5. The inner-face plating treatment will be described later in detail. Next, after the steel sheet of which one face was plated is cooled by the cooling trough 6, the steel sheet is introduced into the forming device 7 and is formed in a tubular shape by cold-forming. Then, the longitudinal end face joint portion of the steel sheet is continuously welded by the welding device 8, so that a continuous single tubular body 9 is formed.

Next, the tubular body 9 is supplied to the cutting device 10 equipped with a blade having a shape according to the outer face of the tubular body 9. Then, the welded bead portion which is formed on the outer face of the tubular body 9 is cut away by the blade of the cutting device 10, so that the outer face of the tubular body 9 becomes smooth.

Subsequently, the tubular body is sent to the flux applying device 11, so that the flux liquid for cleaning the outer face of the tubular body and preventing the oxidization thereof is applied thereon. The tubular body 9 is sent to the preheating device 12 so that residual heat is applied thereto, thereby drying the outer face.

Subsequently, the tubular body is sent to the outer-face molten metal-plating device 13. The tubular body 9 is dipped into the dipping part filled with pumped molten metal in the outer-face molten metal-plating device 13, so that the entire outer face is subjected to the molten metal-plating. The tubular body 9 which was dipped into the dipping part is provided with a molten metal-plated layer having a strong alloy layer, and the surplus molten metal-plating is removed in the wiping device 602, so that the molten metal-plated steel pipe is formed. Subsequently, it is cooled by the cooling trough 14. Furthermore, the outer-face molten metal-plating treatment will be described later in detail.

Then, the molten metal-plated steel pipe is subjected to cold rolling in the sizing device 15 so that the outer diameter is formed into a standard dimension. In the embodiment, the cold rolling is also needed so that the molten metal-plated layer has a comparatively uniform thickness in the circumferential direction. That is, even when the molten metal-plated layer immediately after formed by the outer-face molten metal-plating device has an irregular thickness in the circumferential direction, the molten metal-plated layer may be made to have a comparatively uniform thickness through the subsequent cold rolling or the like. In this way, in the embodiment, after the molten metal-plated layer is formed by the outer-face molten metal-plating device, for example, it is desirable to perform a sizing process such as cold rolling and perform a process which allows the molten metal-plated layer formed by the molten metal-plating treatment to have a comparatively uniform thickness such as a process which equalizes the distribution of the thickness compared to the case immediately after the molten metal layer is formed.

The molten metal-plated steel pipe is cut into a predetermined length by the cutting device 16, so that a steel pipe product 17 is obtained.

Here, the inner-face plating treatment will be described in detail. The inner-face plating treatment is a process in which surplus metal of the molten metal poured from the pouring part 501 of the inner-face molten metal-plating treatment device 5 to the steel sheet B is removed by the wiping part 503. Here, in the invention, a fact is examined in which the molten metal dipping time is proportional to the thickness of the formed alloy layer at the time of performing the molten metal-plating. However, the inner-face plating method which is used in the continuous line is performed according to the method in which molten metal is poured to the steel sheet from the upper side thereof. Here, although "dipping" as the general meaning is not performed, under a premise that the conditions, where the molten-metal is on the steel sheet by pouring, is "dipping", the distance between the pouring part and the wiping part is adjusted as the dipping length of the molten metal. That is, even when the line speed is not changed, the thickness of the plated alloy layer may be adjusted by adjusting the molten metal dipping time in a manner such that the distance between the pouring part 501 and the wiping part 503 is changed. For example, when the line speed is temporarily decreased, the thickness of the plated alloy layer may be maintained so as to be uniform by adjusting the distance between the pouring part 501 and the wiping part 503 to be short. That is, since the thickness of the plated alloy layer may be made to be substantially uniform, a problem such as cracking or peeling of the plated layer hardly occurs.

Further, in the method according to the embodiment, the thickness of the plated layer may be easily adjusted by only adjusting the pressure of air or $N_2$ gas ejected from the wiping part 503. Incidentally, generally, with regard to the manufacturing of the plated steel sheet, the steel sheet is perpendicularly and rapidly raised from the molten metal pot in the case of so-called hot-dipping. At this time, the attachment amount of the molten metal which is raised together with the steel sheet by the viscosity is adjusted by the air or $N_2$ gas wiping. Generally, in this type of process, there is a need to increase the amount of raised molten metal by increasing a speed at which the steel sheet is raised, that is, a speed at which the sheet passes in order to increase the plating attachment amount. However, since the heating capability for plating the steel sheet is determined according to the condition of the facility, the sheet passage speed decreases in the case of the thick-walled steel sheet. Accordingly, the raised molten metal amount decreases, and the plating attachment amount may not be easily increased. In the inner-face metal-plating of the method according to the embodiment, the attachment amount may be controlled by the air or $N_2$ gas wiping pressure regardless or the amount of the raised molten metal and the thickness of the steel sheet in a manner such that the steel sheet passes in the horizontal direction instead of the perpendicular direction.

Next, the outer-face plating treatment will be described in detail. Even in the outer-face plating treatment, the dipping length of the molten metal is important. The thickness of the outer-face plated alloy layer may be adjusted in a manner such that molten metal is charged into the dipping part(s) by the number of the dipping part(s) necessitated to obtain the required thickness of the plated alloy layer among the plural outer-face molten metal-plating devices. Further, due to adjusting the thickness of the plated alloy layer in this way, even when the line speed changes, the thickness of the plated alloy layer of the outer face may be maintained to be uniform.

Figure 8:
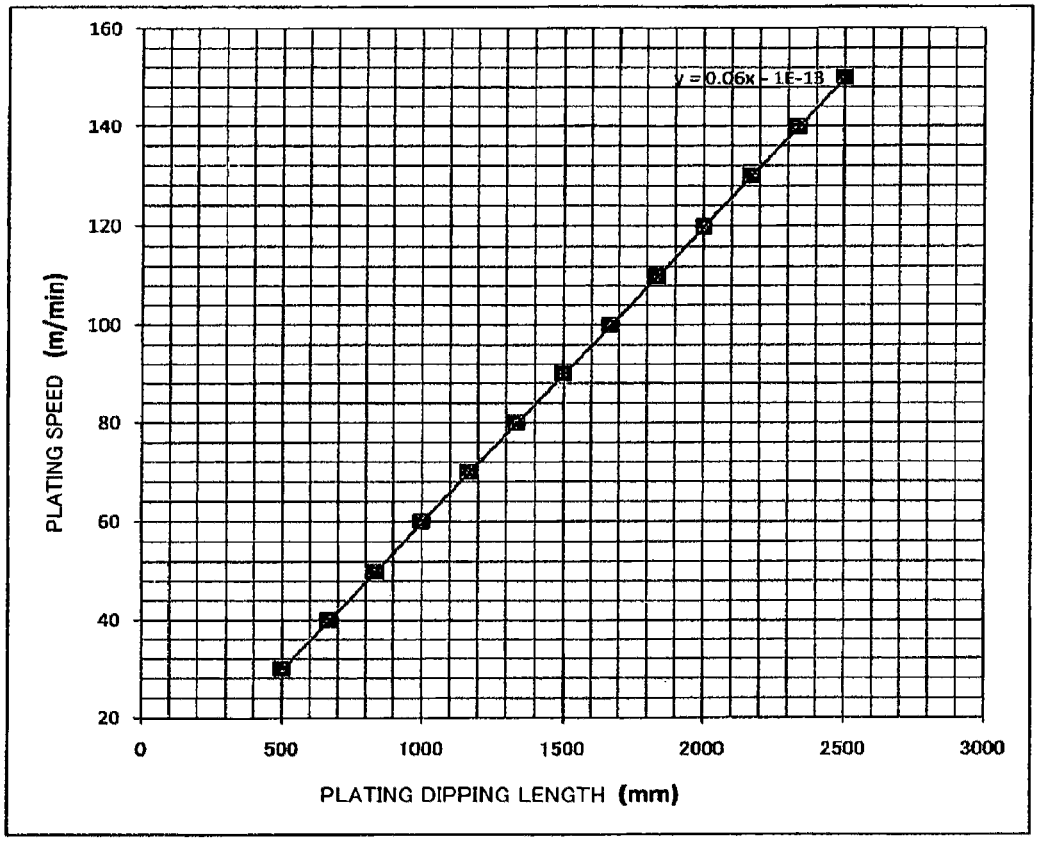
FIG. 8 is a diagram illustrating a relation between a plating speed and a dipping length of molten metal.

Furthermore, from the viewpoint of bending workability, the thickness of the alloy layer is desirably 4 μm or less, is more desirably 3 μm or less, and is further more desirably 2 μm or less. When the thickness of the alloy layer is set to be within this range, cracking or peeling of the plating hardly occurs due to the bending. Here, in order to adjust the thickness of the alloy layer, the plating dipping time is desirably 1 second or less, is more desirably 0.3 seconds or less, and is further more desirably 0.25 seconds or less. FIG. 8 illustrates a relation between the dipping length of the molten metal and the plating speed when the alloy layer is set to be 1 μm. Here, the plating speed herein indicates the length of the steel pipe to be plated in the continuous line per minute, and is equal to the pipe manufacturing speed (the line speed). That is, when the thickness of the alloy layer needs to be maintained to be 1

μm, the dipping length of the molten metal may be set so as to satisfy the relation of FIG. 8 depending on a change in the line speed.

Here, the invention is not limited to the above-described embodiment. For example, in the embodiment, although the molten metal-plated layer is formed on both inner and outer faces using the melting device, the molten metal-plated layer may be formed on only the inner face or the outer face using the molten metal-plating device.

Further, the upper face of the outer-face plated layer may be coated with a protection coating using a synthetic resin. In this way, the rust preventing effect of the molten metal-plated steel pipe may be further improved.

Furthermore, in the embodiment, the plating performed on the steel pipe is not particularly limited, and for example, zinc may be exemplified. However, if necessary, other metal may be applied. Further, the embodiment has been described on the assumption that the steel sheet is used, but the invention may be applied on the assumption that other metal sheets are used. As such a metal sheet, for example, a copper tape, an aluminum tape, or the like is supposed, but the invention is not limited thereto.

WORKING EXAMPLE 1

Figure 9:
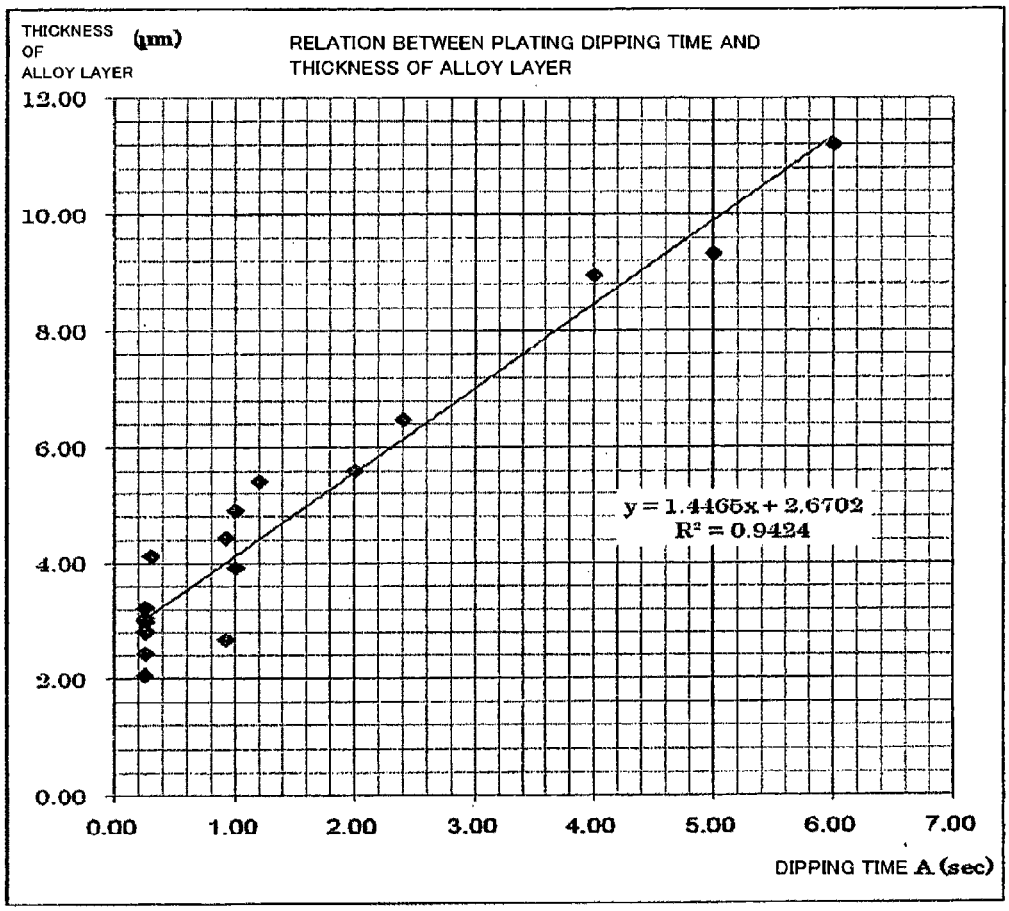
FIG. 9 is a diagram illustrating a relation between a dipping time and a thickness of a galvanized alloy layer.

The rolled steel plate with a thickness of 1.2 mm and a width of 59.5 mm was set on a manufacturing line with the same configuration as that of FIG. 1 except that eight parts illustrated in FIG. 5 were installed. Then, shot blasting was performed on the inner face thereof by the shot blasting device, a molten galvanized layer was formed on the inner face by the inner-face molten metal-plating device, a continuous steel pipe was formed, a molten galvanized layer was formed on the outer face thereof by the outer-face molten metal-plating device, and then the continuous steel pipe was cut. Here, Table 1 lists a relation between the zinc dipping time {(the distance from the position entering in the dipping part to the wiping)/the line speed} and the thickness of the plated alloy layer of the outer face. Then, FIG. 9 is a diagram in which the zinc dipping time is plotted with respect to the thickness of the plated alloy layer. In this way, it is found that the dipping time is proportional to the thickness of the plated alloy layer. Furthermore, the bending workability of the outer-face plating of the steel pipe obtained by the experiment was evaluated. Incidentally, the evaluation of plating bending workability was performed according to JIS G 3444 and JIS G 3445. The cross-sectional images observed by the microscope are illustrated in FIGS. 10 to 12.

TABLE 1

| No | Line speed M/min | Temperature of zinc ° C. | Dipping length M | Number of supplied dipping units | Zinc dipping time sec | Thickness of alloy layer μm | Plating skin |
|---|---|---|---|---|---|---|---|
| 1 | 120 | 459 | 0.5 | 1 | 0.25 | 2.43 | OK |
| 2 | 120 | 459 | 0.5 | 1 | 0.25 | 2.80 | OK |
| 3 | 120 | 459 | 0.5 | 1 | 0.25 | 2.98 | OK |
| 4 | 120 | 459 | 0.5 | 1 | 0.25 | 3.22 | OK |
| 5 | 120 | 459 | 0.5 | 1 | 0.25 | 3.04 | OK |
| 6 | 120 | 459 | 0.5 | 1 | 0.25 | 2.06 | OK |
| 7 | 120 | 459 | 0.5 | 1 | 0.25 | 2.82 | OK |
| 8 | 100 | 459 | 0.5 | 1 | 0.30 | 4.12 | OK |
| 9 | 130 | 457 | 2 | 4 | 0.92 | 4.43 | OK |
| 10 | 130 | 457 | 2 | 4 | 0.92 | 2.67 | OK |
| 11 | 120 | 457 | 2 | 4 | 1.00 | 4.91 | OK |
| 12 | 100 | 459 | 2 | 4 | 1.20 | 5.41 | OK |
| 13 | 60 | 459 | 2 | 4 | 2.00 | 5.60 | OK |
| 14 | 50 | 460 | 2 | 4 | 2.40 | 6.48 | OK |
| 15 | 120 | 457 | 2 | 4 | 1.00 | 3.92 | Zebra |
| 16 | 60 | 464 | 4 | 8 | 4.00 | 8.96 | OK |
| 17 | 48 | 464 | 4 | 8 | 5.00 | 9.33 | OK |
| 18 | 40 | 464 | 4 | 8 | 6.00 | 11.21 | OK |

The invention claimed is:

1. A steel pipe manufacturing system for manufacturing steel pipe, in which at least an inner face of a steel pipe is subjected to molten metal-plating, the steel pipe being manufactured on a continuous steel pipe manufacturing line from a steel sheet, the steel pipe manufacturing line being arranged horizontal so that the steel pipe horizontally travels from an upstream side to a downstream side, the system comprising:

an inner-face plating performing part that performs molten metal-plating by pouring molten metal on an upper side of the steel sheet corresponding to an inner face of the steel pipe; and a steel pipe forming part, which is arranged at the downstream side from the inner-face plating performing part, for obtaining a continuous steel pipe by continuously cold-forming the steel sheet subjected to the inner-face plating into a tubular shape and seam-welding a longitudinal end face joint portion of the steel pipe formed from the steel sheet; wherein the inner-face plating performing part includes:

a pouring part that pours molten metal on the upper side of the steel sheet through a treatment area (TAin), which is defined between an initial treatment position (IPin) and an end treatment position (EPin), the initial treatment position at which the molten metal comes to contact with the steel sheet and being located most upstream in the treatment area, the end treatment position at which the contact between the pouring molten metal and the steel sheet terminates and being located most downstream in the treatment area, a molten metal supply part that supplies molten metal to the pouring part, and an inner-face wiping part that removes surplus molten metal poured by the pouring part, and being arranged at an inner wiping position (WPin) that is at the downstream side from the pouring part, a length from the initial treatment position (IPin) to the inner wiping position (WPin) is defined as a dipping length (DLin), and the dipping length is adjustable along the steel pipe manufacturing line, the system further comprises a slide base frame that is in a linear shape, being parallel to the steel pipe manufacturing line, to which the pouring part is attached, the pouring part is configured to move along the slide base frame, and the dipping length is adjusted by moving the pouring part along the slide base frame.

2. The steel pipe manufacturing system according to claim 1, further comprising, a pretreatment device that provides a preheating on the steel sheet, being located upstream from the inner-face plating performing part, wherein a length from the pretreatment device to the initial treatment position (IPin) of the inner-face plating performing part is defined as a preheating length (PLin), and the preheating length is adjustable in correspondence with the initial treatment position moving upstream or downstream.

3. A steel pipe manufacturing system for manufacturing steel pipe, in which an inner face and an outer face of a steel pipe are subjected to molten metal-plating, the steel pipe being manufactured on a continuous steel pipe manufacturing line from a steel sheet, the steel pipe manufacturing line being arranged horizontal so that the steel pipe horizontally travels from an upstream side to a downstream side, the system comprising:

an inner-face plating performing part that performs molten metal-plating by pouring molten metal on an upper side of the steel sheet corresponding to an inner face of the steel pipe;

a steel pipe forming part, which is arranged at the downstream side from the inner-face plating performing part, for obtaining a continuous steel pipe by continuously cold-forming the steel sheet subjected to the inner-face plating into a tubular shape and seam-welding a longitudinal end face joint portion of the steel pipe formed from the steel sheet; and an outer-face plating performing part, which is arranged at the downstream side from the steel pipe forming part, that performs molten metal-plating by dipping the outer face of the steel pipe into molten metal, wherein the inner-face plating performing part includes:

a pouring part that pours molten metal on the upper side of the steel sheet through a treatment area (TAin), which is defined between an initial treatment position (IPin) and an end treatment position (EPin), the initial treatment position at which the molten metal comes to contact with the steel sheet and being located most upstream in the treatment area, the end treatment position at which the contact between the pouring molten metal and the steel sheet terminates and being located most downstream in the treatment area, a molten metal supply part that supplies molten metal to the pouring part, and an inner-face wiping part that removes surplus molten metal poured by the pouring part, a length from the initial treatment position (IPin) to the inner wiping position (WPin) is defined as a dipping length (DLin), and the dipping length is adjustable along the steel pipe manufacturing line;

the system further comprises a slide base frame that is in a linear shape, being parallel to the steel pipe manufacturing line, to which the pouring part is attached;

the pouring part is configured to move along the slide base frame; and the dipping length is adjusted by moving the pouring part along the slide base frame; and the outer-face plating performing part includes:

a dipping part that has a treatment area (TAout) for allowing the continuous steel pipe to pass there through and allows the outer face of the continuous steel pipe to be dipped into molten metal when molten metal is introduced into the treatment area, which is defined between an initial treatment position (IPout) and an end treatment position (EPout), the initial treatment position at which the steel pipe first enters a pool filled with the molten metal and being located most upstream in the treatment area, the end treatment position at which the contact between the molten metal and the steel pipe terminates and being located most downstream in the treatment area, a molten metal supply part that supplies the molten metal to the dipping part, and an outer-face wiping part that removes surplus molten metal from the continuous steel pipe dipped into the molten metal by the dipping part, and being arranged at an outer wiping position (WPout) that is at the downstream side from the pouring part, wherein a length from the initial treatment position (IPout) to the outer wiping position (WPout) is defined as a dipping length (DLout), and the dipping length is adjustable along the steel pipe manufacturing line.

4. The system according to claim 1 or 3, wherein the inner-face wiping part is in a fixed position.

5. The system according to claim 1 or 3, wherein the inner-face wiping part is movable between different positions.

6. The system according to claim 3, wherein the outer-face wiping part is movable between different positions.

7. The system according to claim 3, wherein the outer-face wiping part is in a fixed position.

8. The system according to claim 3, wherein the outer-face plating performing part further comprises a plurality of dipping parts arranged continuously in a direction in which the continuous steel pipe advances, the molten metal supply part supplying molten metal to a number of dipping parts from among the plurality of the dipping parts on a changing-number basis.

9. The system according to claim 8, wherein the outer-face plating performing part further comprises a plurality of outer-face wiping parts, the outer-face wiping parts from among the plurality of outer-face wining parts being arranged to alternate with the dipping parts from among the plurality of dipping parts, wherein the wiping parts from among the plurality of wiping parts can be individually operated.

10. The system according to claim 9, wherein each of the outer-face wiping parts from among the plurality of outer-face wiping parts has an annular portion provided with a circular opening on an interior of the outer-face wiping parts for receiving the continuous steel pipe, the outer-face wiping parts having a plurality of gas-ejecting holes on the interior of the outer-face wiping parts, the annular portion of each of the outer-face wiping parts being openable and each of the outer-face wiping parts being movable to a position distant from the continuous steel pipe.

11. The steel pipe manufacturing system according to claim 3, further comprising, a preheating device that provides a preheating on the steel pipe, being located upstream from the outer-face plating performing part, being in a fixed position with respect to the steel pipe manufacturing line, wherein a length from the preheating device to the initial treatment position (IPout) of the outer-face plating performing part is defined as a preheating length (PLout), and the preheating length is adjustable in correspondence with the initial treatment position moving upstream or downstream.

12. The steel pipe manufacturing system according to claim 3, further comprising, a pretreatment device that provides a preheating on the steel sheet, being located upstream from the inner-face plating performing part, wherein a length from the pretreatment device to the initial treatment position (IPin) of the inner-face plating performing part is defined as a preheating length (PLin), and the preheating length is adjustable in correspondence with the initial treatment position moving upstream or downstream.

* * * * *